US008042521B2

(12) United States Patent
Yamada

(10) Patent No.: US 8,042,521 B2
(45) Date of Patent: Oct. 25, 2011

(54) ENGINE UNIT AND VEHICLE PROVIDED WITH THE SAME

(75) Inventor: Takayuki Yamada, Shizuoka (JP)

(73) Assignee: Yamaha Hatsudoki Kabushiki Kaisha, Iwata-Shi (JP)

( * ) Notice: Subject to any disclaimer, the term of this patent is extended or adjusted under 35 U.S.C. 154(b) by 507 days.

(21) Appl. No.: 12/247,883

(22) Filed: Oct. 8, 2008

(65) Prior Publication Data

US 2009/0101088 A1 Apr. 23, 2009

(30) Foreign Application Priority Data

Oct. 10, 2007 (JP) ..... 2007-264683

(51) Int. Cl.
*F02M 55/02* (2006.01)

(52) U.S. Cl. ..... 123/468; 123/54.4; 123/184.31; 123/469; 123/336

(58) Field of Classification Search ..... 123/184.31, 123/54.4, 336
See application file for complete search history.

(56) References Cited

U.S. PATENT DOCUMENTS

| | | | | |
|---|---|---|---|---|
| 2,869,527 | A * | 1/1959 | Groves | 123/459 |
| 2002/0185323 | A1* | 12/2002 | Tsutsumi et al. | 180/219 |
| 2004/0244768 | A1* | 12/2004 | Udono | 123/336 |
| 2006/0157021 | A1* | 7/2006 | Nakagawa | 123/336 |
| 2006/0213475 | A1* | 9/2006 | Sekimoto | 123/184.35 |
| 2008/0029062 | A1* | 2/2008 | Toriumi et al. | 123/337 |
| 2008/0184958 | A1* | 8/2008 | Sato et al. | 123/336 |

FOREIGN PATENT DOCUMENTS

JP 2002-256900 9/2002

* cited by examiner

*Primary Examiner* — Michael Cuff
*Assistant Examiner* — Hung Q Nguyen
(74) *Attorney, Agent, or Firm* — Robin & Berdo, PC

(57) ABSTRACT

An engine unit with a decreased height dimension and longitudinal length comprises an engine and a throttle body assembly. The throttle body assembly includes front and rear throttle bodies formed with front and rear air cylinders and throttle valves. A fuel supply pipe is arranged between central axes of the air cylinders in a longitudinal direction to extend widthwise in a lower position than upper ends of the throttle bodies. A motor for driving throttle valves is arranged between the central axes of the air cylinders in the longitudinal direction. An axis of a rotating shaft of the motor is positioned forwardly or rearwardly of a central axis of the fuel supply pipe.

9 Claims, 12 Drawing Sheets

ENGINE UNIT AND VEHICLE PROVIDED WITH THE SAME

CROSS REFERENCE TO RELATED APPLICATIONS

This application claims the benefit of priority under 35 USC 119 of Japanese patent application no. 2007-264683, filed on Oct. 10, 2007, which is incorporated by reference.

BACKGROUND OF THE INVENTION

1. Field of the Invention

The present invention relates to an engine unit for a vehicle comprising a V-type engine and a throttle body assembly.

2. Description of Related Art

Various throttle body assemblies for V-type engines are conventionally known. For example, FIGS. 11 and 12 show a throttle body assembly 100 of a V-type engine as described in JP-A-2002-256900. As shown in FIG. 11, a motor 102 is arranged in a region surrounded by throttle bodies 103, 104 as viewed in plan view. Throttle valves 101 are driven by motor 102. As shown in FIG. 12, a front fuel supply pipe 105 and a rear fuel supply pipe 106 are arranged above motor 102 and between throttle bodies 103 and 104. Front fuel supply pipe 105 supplies fuel to a front injector 107 and rear fuel supply pipe 106 supplies fuel to a rear injector 108.

Because motor 102 and fuel supply pipes 105 and 106 are arranged between throttle bodies 103 and 104, throttle body assembly 100 can be decreased in magnitude as viewed in plan view. However, fuel supply pipes 105, 106 are aligned on throttle body assembly 100 in a longitudinal direction. Therefore, throttle bodies 103 and 104 must be arranged distantly from each other. Also, fuel supply pipes 105, 106 and motor 102 are aligned in a vertical direction. Since motor 102 vibrates due to engine vibrations, etc., some clearance between fuel supply pipes 105, 106 and motor 102 must be provided. Therefore, fuel supply pipes 105, 106 and motor 102 must be arranged away from each other. Accordingly, the height dimension of throttle body assembly 100 is increased. That is, with the construction shown in FIGS. 11 and 12, it is difficult to make the throttle body assembly sufficiently small in size. Accordingly, there is caused a problem in that it is difficult to make an engine unit, which includes the throttle body assembly, small in size.

SUMMARY OF THE INVENTION

The invention addresses this problem and provides an engine unit with both a decreased height dimension and decreased longitudinal length.

An engine unit according to the invention comprises a V-type engine and a throttle body assembly. The V-type engine is formed with a front cylinder connected to a front intake port and a rear cylinder connected to a rear intake port. The throttle body assembly is mounted to the V-type engine and includes a front throttle body, a rear throttle body, a fuel supply pipe and a motor. The front throttle body is formed with a front air cylinder that is connected to the front intake port and a front throttle valve for opening and closing the front air cylinder. The rear throttle body is formed with a rear air cylinder that is connected to the rear intake port and a rear throttle valve for opening and closing the rear air cylinder. The fuel supply pipe is arranged between central axes of the front and rear air cylinders in a longitudinal direction. The fuel supply pipe extends widthwise in a lower position than a higher one of an upper end of the front throttle body and an upper end of the rear throttle body. The fuel supply pipe supplies fuel to the front and rear air cylinders. The motor includes a rotating shaft extending in a width direction and is arranged between the central axes of the front and rear air cylinders in a longitudinal direction. The motor drives the front and rear throttle valves. An axis of the rotating shaft of the motor is positioned forwardly or rearwardly of a central axis of the fuel supply pipe.

According to the invention, an engine unit that is decreased both in height dimension and longitudinal length is provided.

Other features and advantages of the invention will be apparent from the following detailed description, taken in conjunction with the accompanying drawings that illustrate, by way of example, various features of embodiments of the invention.

DETAILED DESCRIPTION OF THE INVENTION

Figure 1:
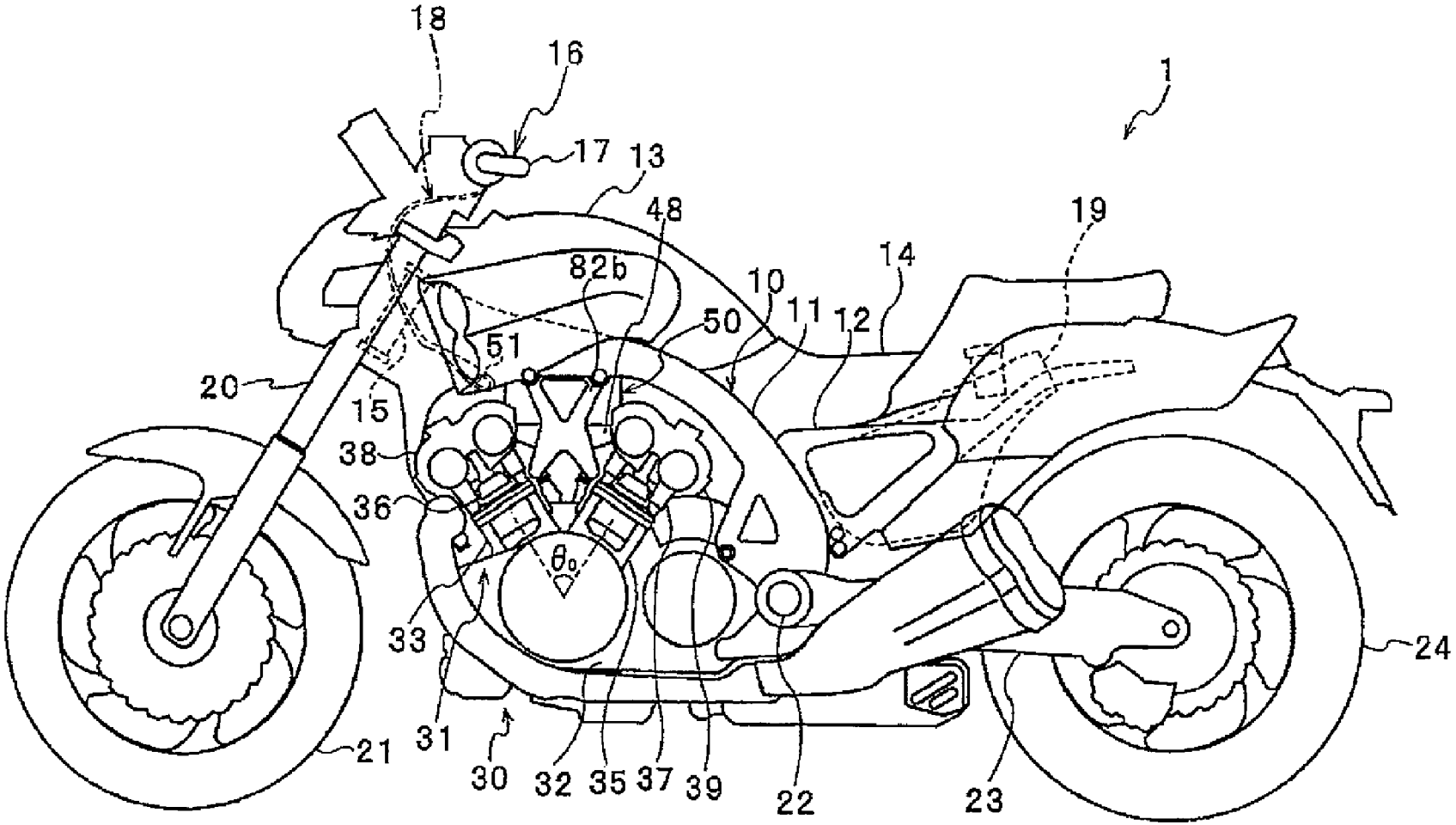
FIG. 1 is a schematic, left side view of a motorcycle according to the invention.

Embodiments of the invention are now described with reference to motorcycle 1 of FIG. 1 as an example. However, a vehicle according to the invention is not limited to motorcycle 1 of FIG. 1 and is not specifically limited provided that a V-type engine is provided. A vehicle according to the invention, for example, may be a four-wheel car or a straddle-type vehicle. Here, a "straddle-type vehicle" means a vehicle of a type in which a rider straddles a seat (straddle) and may be, for example, an ATV (All Terrain Vehicle) or a motorcycle. Also, a motorcycle according to the invention is not limited to a so-called American type as shown in FIG. 1 and may be a moped, scooter, off-road vehicle, etc. A motorcycle as described herein includes any vehicle having a plurality of wheels, of which at least one of a front and a rear wheel rotates integrally, and that is inclined to change a traveling direction.

In addition, in the following description, directional terms such as "longitudinal", "left", "right", "front", "rear", etc. are directions from a perspective of a rider seated on a seat 14.

(Outline Construction of Motorcycle 1)

FIG. 1 is a schematic side view of motorcycle 1. As shown in FIG. 1, motorcycle 1 comprises a body frame 10, a body cover 13 and a seat 14. Body cover 13 covers a part of body frame 10. Seat 14 is arranged on body frame 10.

Body frame 10 comprises a main frame 11 and a rear frame 12. Main frame 11 comprises left and right frame portions

11*a*, 11*b* extending rearward from a head pipe 15. Head pipe 15 is turnably mounted to main frame 11. A handle 16 is fixed to an upper end of head pipe 15 by a handle holder. A throttle grip 17 as a throttle operating element is provided on handle 16. Throttle grip 17 is connected to an accelerator position sensor (APS) 51 by a throttle wire 18. Therefore, when throttle grip 17 is operated by a rider, throttle wire 18 is moved and a manipulated variable of throttle grip 17 is detected as an accelerator position by accelerator position sensor 51.

Left and right front forks 20 are fixed to head pipe 15. Front forks 20 are extended forward and obliquely downward. A front wheel 21 is mounted rotatably to lower ends of front forks 20. A pivot shaft 22 is mounted to a rear end of body frame 10. A rear arm 23 is swingably mounted to pivot shaft 22. A rear wheel 24 is mounted rotatably to a rear end of rear arm 23. Rear wheel 24 is connected to an output shaft of engine unit 30 by a power transmission mechanism of a drive shaft or the like. Power of engine unit 30 is thereby transmitted to and rotates rear wheel 24.

Figure 2:
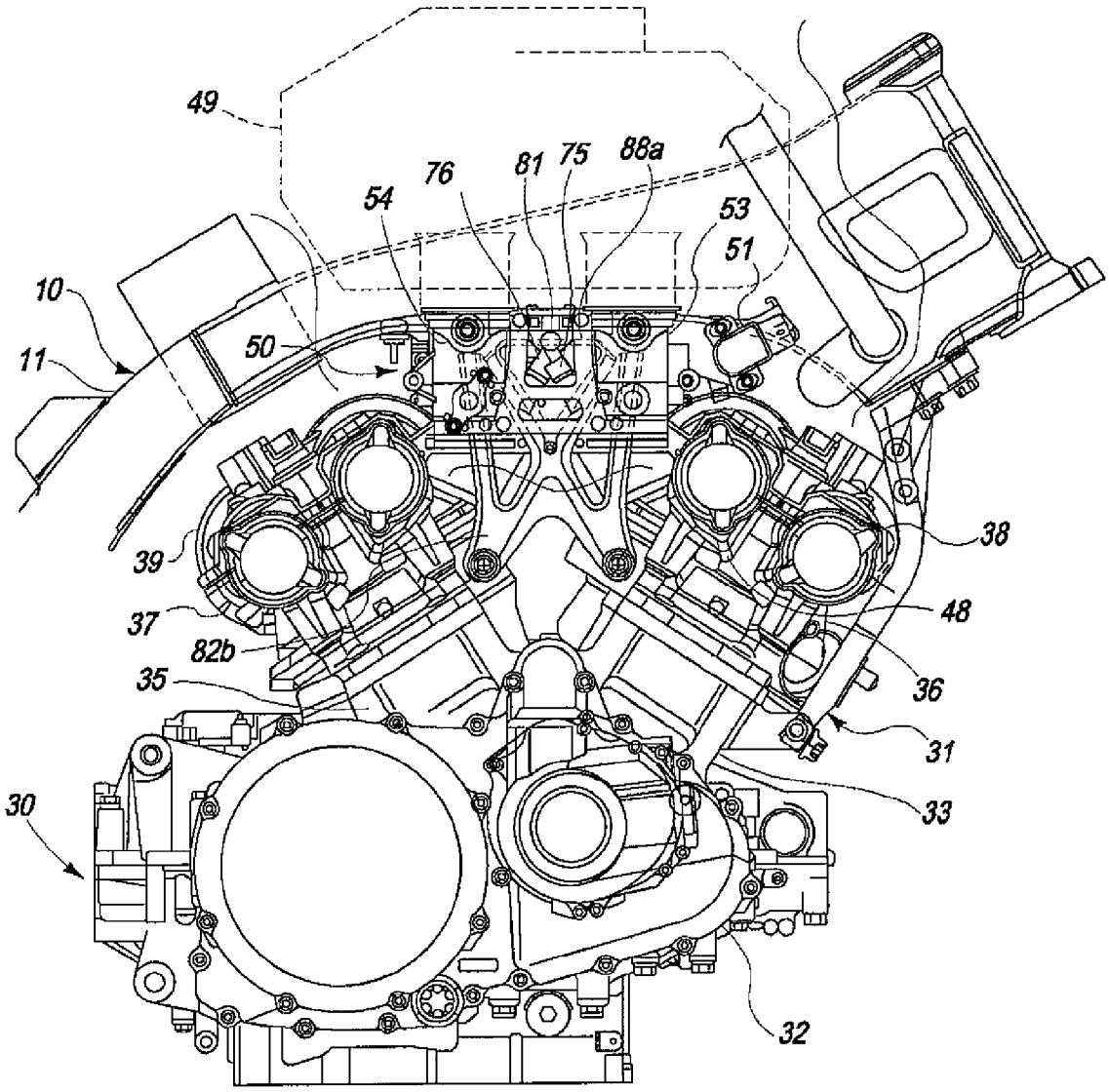
FIG. 2 is an enlarged right side view of an engine unit of the motorcycle.
Figure 4:
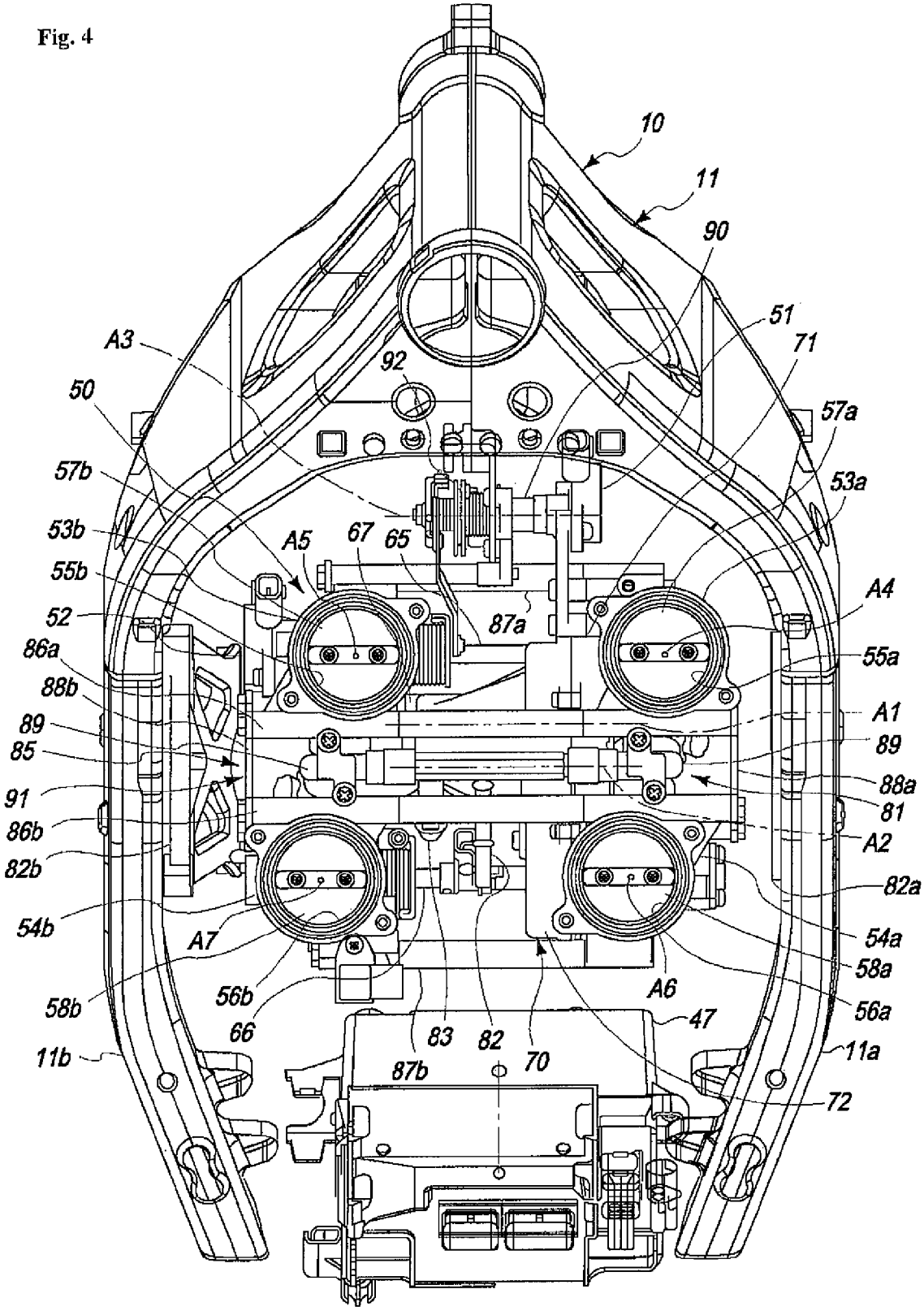
FIG. 4 is a plan view of the throttle body assembly.

As shown in FIGS. 1 and 2, engine unit 30 is suspended from main frame 11 and comprises a V-type engine 31, a throttle body assembly 50, a clutch and a transmission mechanism. Throttle body assembly 50 is arranged on engine 31. As shown in FIG. 4, throttle body assembly 50 is arranged between left and right frame portions 11*a*, 11*b* as viewed in plan view.

Figure 3:
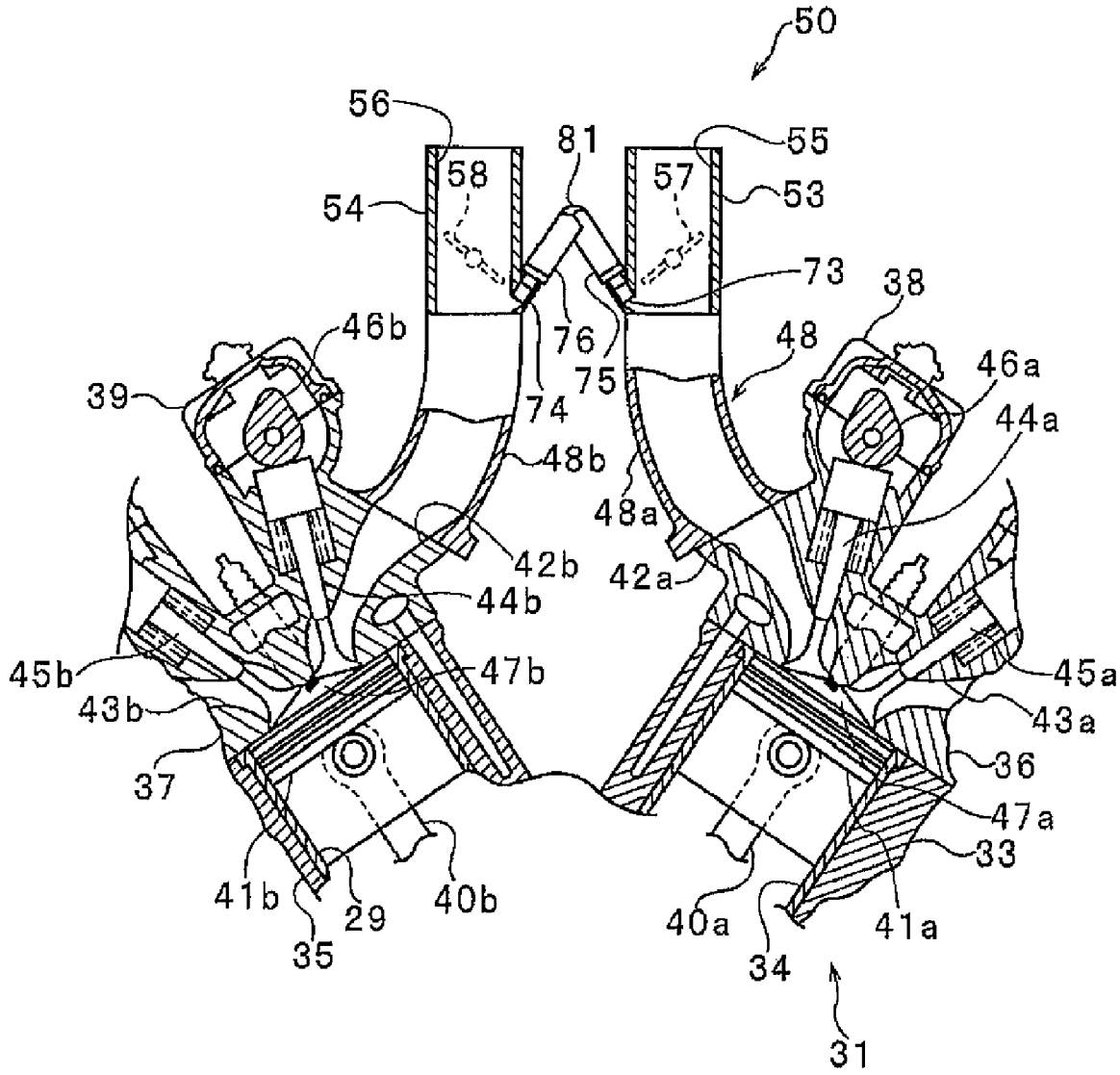
FIG. 3 is a cross sectional view showing parts of an engine and a throttle body assembly of the engine unit.

An insulator 48 is arranged between engine unit 30 and throttle body assembly 50. Insulator 48, engine 31 and throttle body assembly 50 are fixed to one another by X members 82*a*, 82*b* arranged on both sides in a vehicle width direction. As shown in FIG. 3, insulator 48 is formed with communication paths 48*a*, 48*b*. Intake ports 42*a*, 42*b* of engine 31 and respective air cylinders 55, 56 of throttle body assembly 50 are connected together by communication paths 48*a*, 48*b*.

As shown in FIG. 2, an air cleaner 49 as an intake part is arranged above throttle body assembly 50. Outside air is supplied to throttle body assembly 50 through air cleaner 49. While an embodiment is described in which air cleaner 49 is provided as an intake part, other configurations may be utilized, for example, an air chamber may be arranged as an intake part in place of air cleaner 49.

As shown in FIG. 1, a fuel tank 19 is arranged rearwardly of engine 31. Fuel tank 19 is connected to a fuel nipple 82 of throttle body assembly 50, shown in FIG. 4, by a fuel supply hose. Therefore, fuel stored in fuel tank 19 is supplied to throttle body assembly 50 via the fuel supply hose. Air and fuel supplied to throttle body assembly 50 are mixed in throttle body assembly 50 to create an air-fuel mixture that is supplied to engine 31.

As shown in FIG. 4, a battery 47 that supplies electricity to engine unit 30 and throttle body assembly 50 is mounted just rearwardly of throttle body assembly 50 in a space surrounded by main frame 11 as viewed in plan view.

(Engine 31)

A configuration of engine 31 is now described mainly with reference to FIGS. 1-3. In this embodiment, engine 31 is a water-cooled four-stroke V-type four-cylinder engine. In the invention, however, engine 31 is not specifically limited as long as it is a V-type engine. For example, engine 31 may be an air-cooled engine or a two-stroke engine. Also, engine 31 may be a V-type engine having three or less cylinders or five or more cylinders.

A "V-type engine" as described herein means an engine including front and rear cylinders that are arranged to define a V bank. That is, the front and rear cylinders are arranged so that their central axes intersect each other obliquely about the axis of the crank shaft.

As shown in FIG. 2, engine 31 comprises a crank case 32. A crank shaft is received in crank case 32. A front cylinder body 33 and a rear cylinder body 35 are mounted to crank case 32 and are arranged in a V-shaped manner about the crank shaft as viewed in side view. A front cylinder head 36 is mounted above front cylinder body 33, and a front head cover 38 is mounted further above front cylinder head 36. Likewise, a rear cylinder head 37 is mounted above rear cylinder body 35, and a rear head cover 39 is mounted above rear cylinder head 37.

As shown in FIG. 3, substantially columnar-shaped front cylinders 34 are formed in front cylinder body 33 and substantially columnar-shaped rear cylinders 29 are formed in rear cylinder body 35. Front cylinders 34 and rear cylinders 29 are arranged to define a V bank. More specifically, while front cylinders 34 are arranged upward and obliquely forward, rear cylinders 29 are arranged upward and obliquely rearward. An angle $\theta_0$ formed between central axes of front cylinders 34 and central axes of rear cylinders 29 (FIG. 1) is set to a magnitude that eliminates positional interference between front cylinders 34 and rear cylinders 29, or more in view of engine sound generated from engine 31 and characteristics of engine 31 being obtained. For example, $\theta_0$ is usually set to at least 10° and at most 170°, preferably, to at least 30° and at most 150°, and more preferably, to at least 45° and at most 100°.

As shown in FIG. 3, connecting rods 40*a*, 40*b* connected to a crank shaft are received, respectively, in front cylinders 34 and rear cylinders 29. Pistons 41*a*, 41*b* are mounted to tip ends of connecting rods 40*a*, 40*b*. Combustion chambers 47*a*, 47*b* are compartmented and formed by pistons 41*a*, 41*b*, cylinders 34, 29, and cylinder heads 36, 37.

Intake ports 42*a*, 42*b* and exhaust ports 43*a*, 43*b* are formed, respectively, in front cylinder head 36 and rear cylinder head 37. Intake valves 44*a*, 44*b* for opening and closing intake ports 42*a*, 42*b* are arranged on intake ports 42*a*, 42*b* and are driven by intake cams 46*a*, 46*b* arranged on upper surfaces of intake valves 44*a*, 44*b*. Exhaust valves 45*a*, 45*b* for opening and closing exhaust ports 43 are arranged on exhaust ports 43*a*, 43*b* and are driven by exhaust cams.

(Throttle Body Assembly 50)

—Front throttle body 53 and rear throttle body 54—

Throttle body assembly 50 is now described in detail mainly with reference to FIGS. 4-9. Throttle body assembly 50 comprises a first front throttle body 53*a* and a second front throttle body 53*b*. First front throttle body 53*a* and second front throttle body 53*b* may be generally referred to as front throttle bodies 53 in the following description.

Throttle bodies 53*a* and 53*b* are arranged in a vehicle width direction. First front throttle body 53*a* is formed with a substantially columnar-shaped first front air cylinder 55*a* and second front throttle body 53*b* is formed with a substantially columnar-shaped second front air cylinder 55*b*. Air cylinders 55*a* and 55*b* are extended vertically and may be generally referred to as front air cylinders 55 in the following description.

Front throttle bodies 53*a*, 53*b*, respectively, include front throttle valves 57*a*, 57*b*. Front throttle valves 57*a*, 57*b* may be generally referred to as front throttle valves 57 in the following description. Throttle valves 57*a* and 57*b* are connected to each other by a valve stem 65. Valve stem 65 is rotated by a motor 60 to simultaneously move throttle valves 57*a* and 57*b*, so that air cylinders 55*a*, 55*b* are opened and closed.

A first rear throttle body 54*a* and a second rear throttle body 54*b* are arranged rearwardly of front throttle bodies 53*a*, 53*b*. Rear throttle bodies 54*a* and 54*b* may be generally referred to as rear throttle bodies 54 in the following description. Rear throttle bodies 54*a* and 54*b* are aligned in a vehicle width direction. First rear throttle body 54*a* is arranged substantially rearwardly of first front throttle body 53*a*, and second rear throttle body 54*b* is arranged substantially rearwardly of second front throttle body 53*b*. However, from the viewpoint of arrangement of connecting rods 40*a*, 40*b*, front throttle bodies 53*a*, 53*b* and rear throttle bodies 54*a*, 54*b* are arranged slightly offset from each other in the vehicle width direction.

In addition, according to the embodiment, upper ends of front throttle bodies 53*a* and 53*b* and upper ends of rear throttle bodies 54*a* and 54*b* are positioned in the same level.

First rear throttle body 54*a* is formed with a first rear air cylinder 56*a* substantially in the form of a column, and second rear throttle body 54*b* is formed with a second rear air cylinder 56*b* substantially in the form of a column. Rear air cylinders 56*a* and 56*b* may be generally referred to as rear air cylinders 56 in the following description.

Rear throttle bodies 54*a*, 54*b*, respectively, include rear throttle valves 58*a*, 58*b*. Rear throttle valves 58*a*, 58*b* may be generally referred to as rear throttle valves 58 in the following description. Throttle valves 58*a* and 58*b* are connected to each other by a valve stem 66. Valve stem 66 is rotated by motor 60 to simultaneously move rear throttle valves 58*a*, 58*b*, so that rear air cylinders 56*a*, 56*b* are opened and closed.

As shown in FIG. 2, upper ends of front air cylinder 55 and rear air cylinder 56 are connected to air cleaner 49. As shown in FIG. 3, lower ends of front air cylinders 55 and rear air cylinders 56 are connected to intake ports 42*a*, 42*b*. Air sucked from air cleaner 49 is thereby supplied to engine 31 through throttle body assembly 50.

—Injectors 75, 76 and Fuel Supply Pipe 81—

Figure 8:
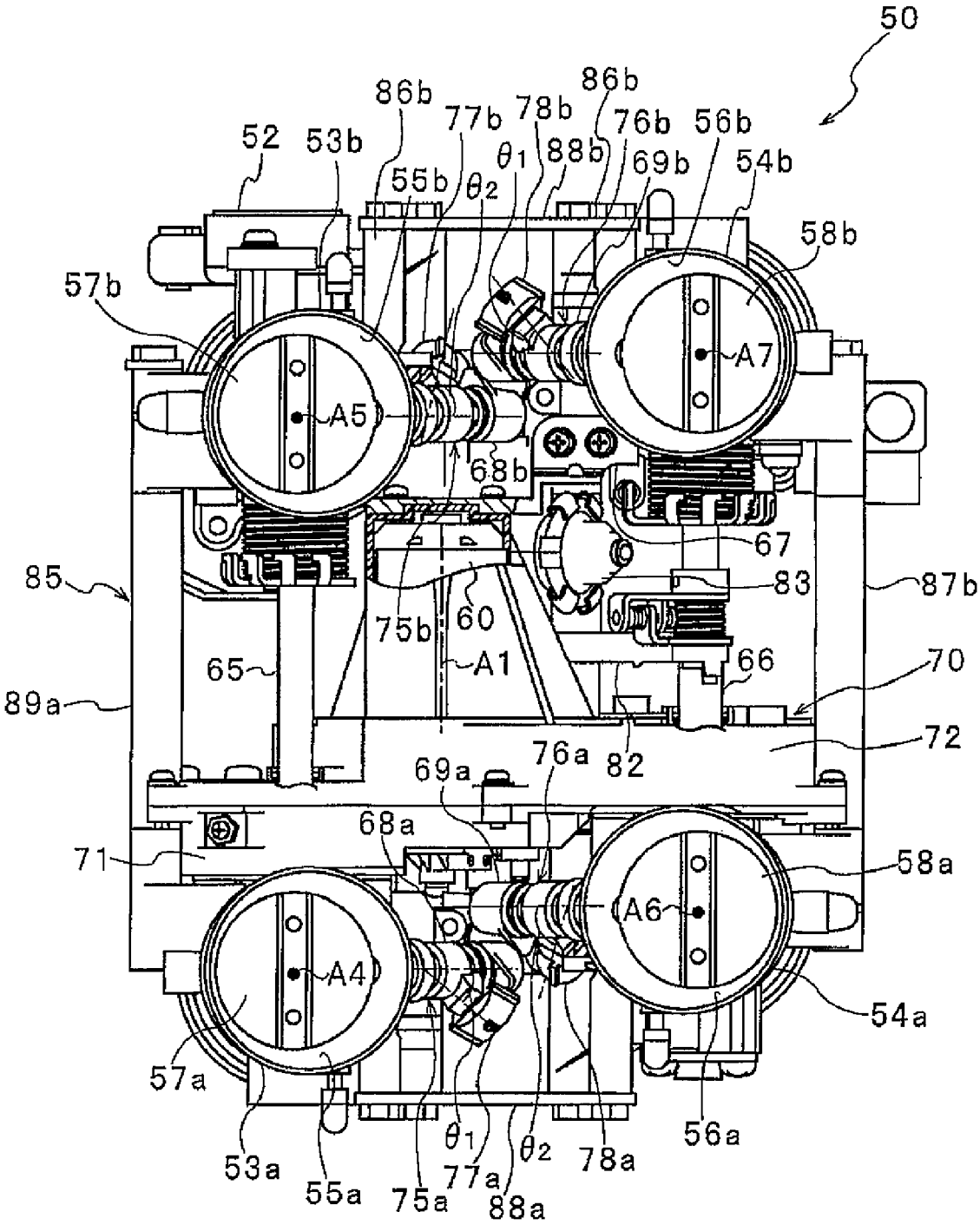
FIG. 8 is a rear view of the throttle body assembly.

As shown mainly in FIG. 8, front injectors 75*a*, 75*b* are mounted to front throttle bodies 53*a*, 53*b*, respectively, and rear injectors 76*a*, 76*b* are mounted to rear throttle bodies 54*a*, 54*b*, respectively. In the following description, front injectors 75*a*, 75*b* may be generally referred to as front injectors 75 and rear injectors 76*a*, 76*b* may be generally referred to as rear injectors 76.

As shown in FIGS. 2 and 3, upper ends of injectors 75 and 76 are connected to a fuel supply pipe 81. As shown in FIG. 4, fuel supply pipe 81 is extended between air cylinders 55 and 56 in the vehicle width direction. More specifically, in a longitudinal direction, fuel supply pipe 81 is arranged so that its central axis A2 is positioned centrally between central axes A4, A5 of front air cylinders 55 and central axes A6, A7 of rear air cylinders 56. In a vertical direction, fuel supply pipe 81 is arranged in a position lower than upper ends of throttle bodies 53 and 54, but higher than lower ends of throttle bodies 53 and 54. In a case where upper ends of throttle bodies 53 and 54 are different in level from each other, fuel supply pipe 81 is preferably arranged in a position lower than higher ones of the upper ends of front throttle bodies 53 and the upper ends of rear throttle bodies 54.

As shown in FIG. 4, fuel nipple 82 is connected and extended rearwardly of fuel supply pipe 81 between rear air cylinders 56*a* and 56*b*. Fuel nipple 82 is connected to fuel tank 19 by a fuel supply pipe. Fuel stored in fuel tank 19 is thereby supplied to injectors 75 and 76 through the fuel supply pipe, fuel nipple 82 and fuel supply pipe 81.

As shown in FIGS. 4 and 8, a pulsation damper 83 is mounted to fuel supply pipe 81 and is positioned rearwardly of and slightly obliquely downwardly of fuel supply pipe 81. Pulsation damper 83 suppresses pulsation of fuel supplied to injectors 75 and 76.

Nozzles 73 mounted to tip ends of front injectors 75 (FIG. 3) are regulated so that fuel jetted from front injectors 75 is jetted centering around directions along central axes of front air cylinders 55. Likewise, nozzles 74 mounted to tip ends of rear injectors 76 are regulated so that fuel is jetted centering around directions along central axes of rear air cylinders 56.

Figure 6:
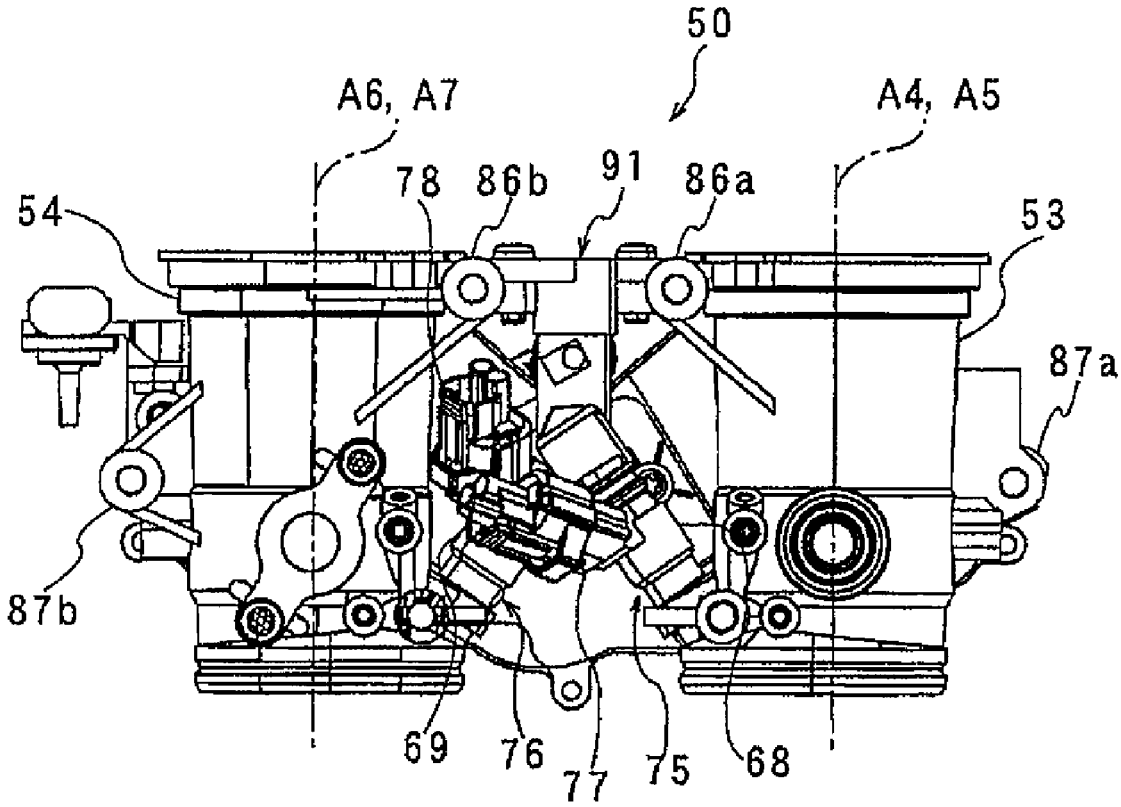
FIG. 6 is a right side view of the throttle body assembly.
Figure 7:
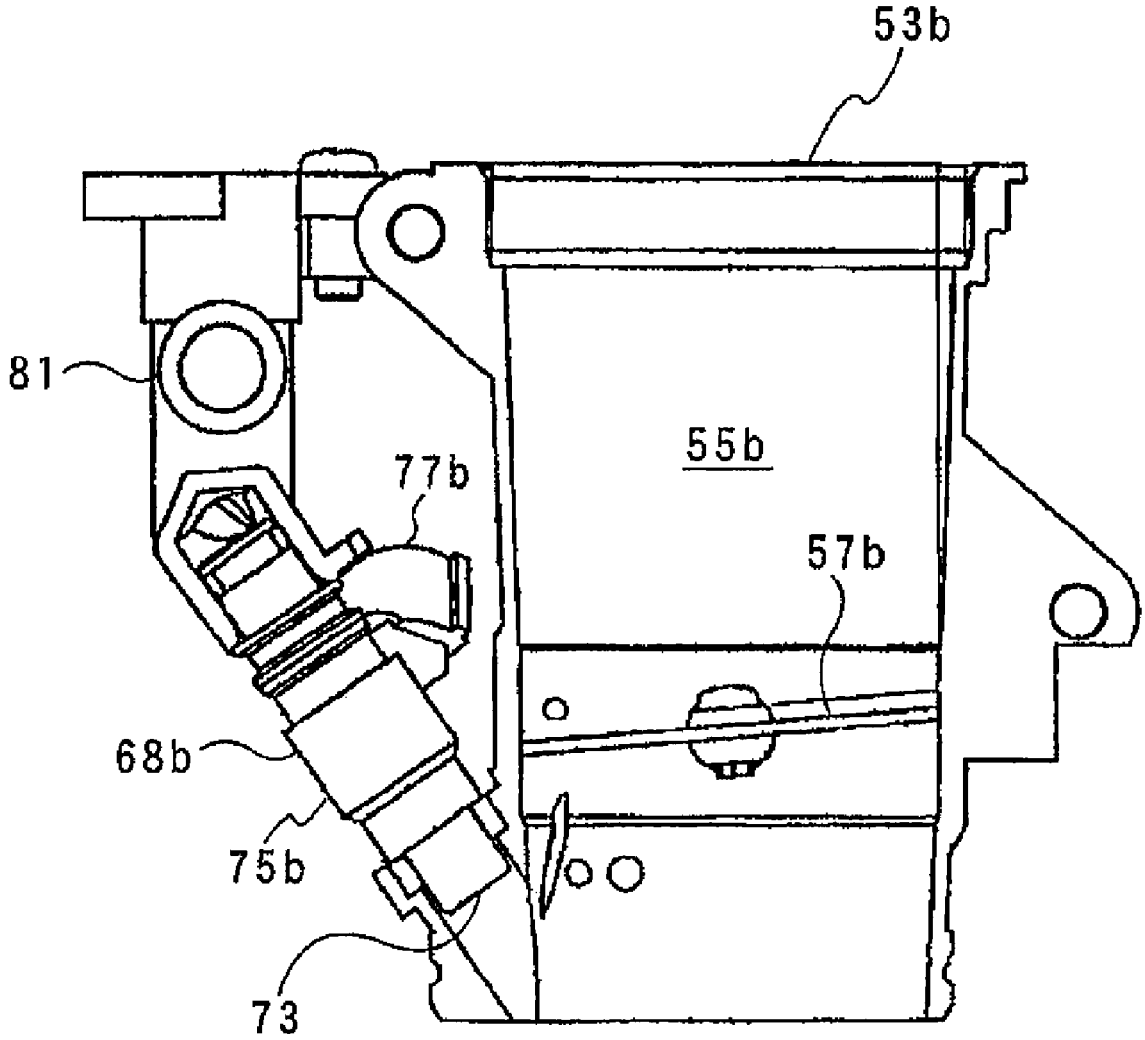
FIG. 7 is a cross sectional view of a second front throttle body.

As shown in FIGS. 6 and 8, front injectors 75*a*, 75*b* comprise injector bodies 68*a*, 68*b* and first front connectors 77*a*, 77*b*. Rear injectors 76*a*, 76*b* comprise injector bodies 69*a*, 69*b* and first rear connectors 78*a*, 78*b*. In the following description, injector bodies 68*a*, 68*b* may be referred to as injector bodies 68, first front connectors 77*a*, 77*b* may be referred to as front connectors 77, injector bodies 69*a*, 69*b* may be referred to as injector bodies 69, and first rear connectors 78*a*, 78*b* may be referred to as rear connectors 78.

Figure 10:
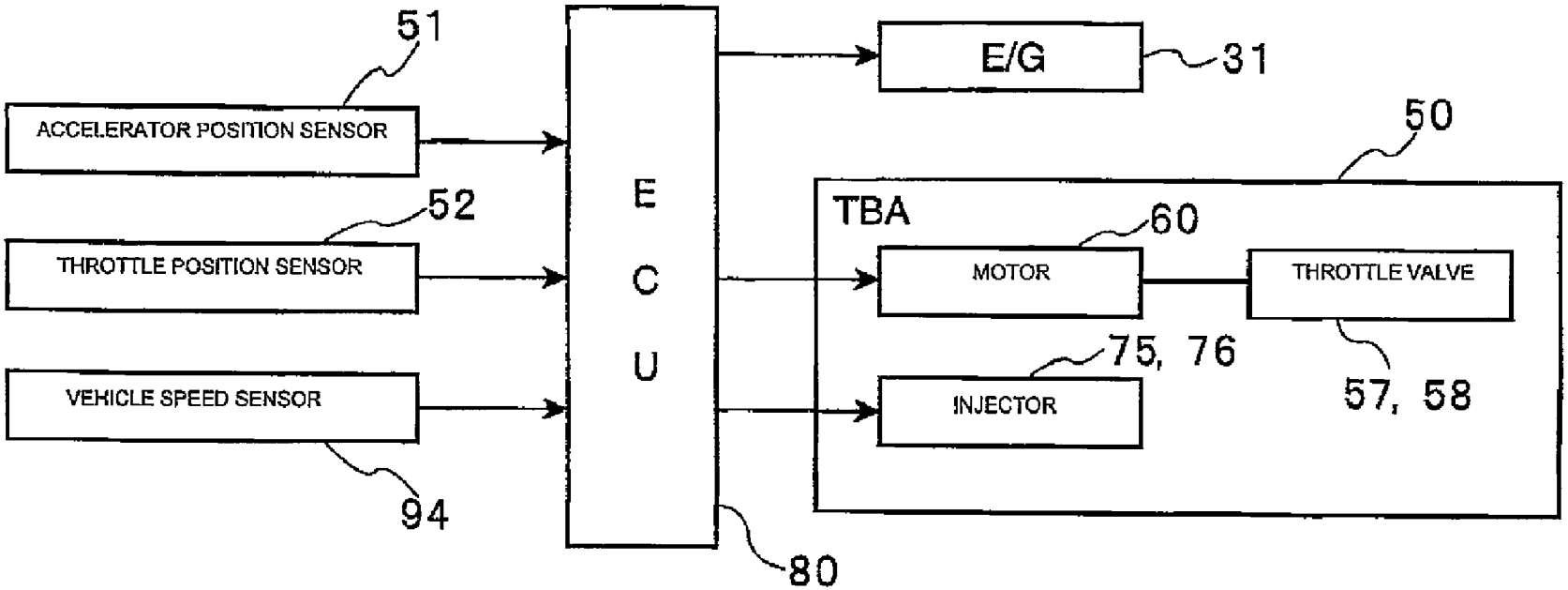
FIG. 10 is a schematic block diagram of a control block of the motorcycle.
Figure 11:
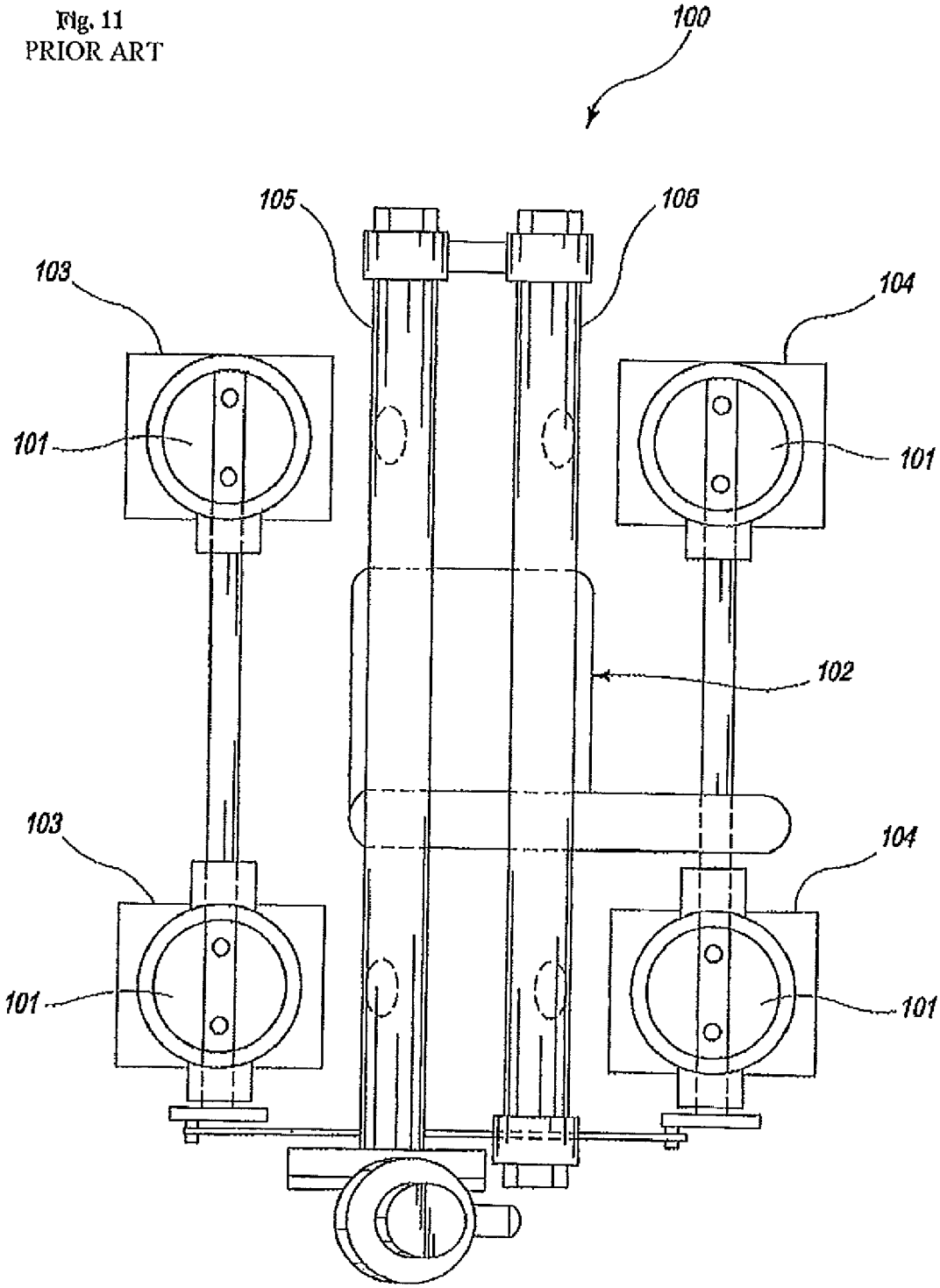
Fig. 11 PRIOR ART
FIG. 11 is a plan view of a throttle body assembly of a V-type engine of the related art.
Figure 12:
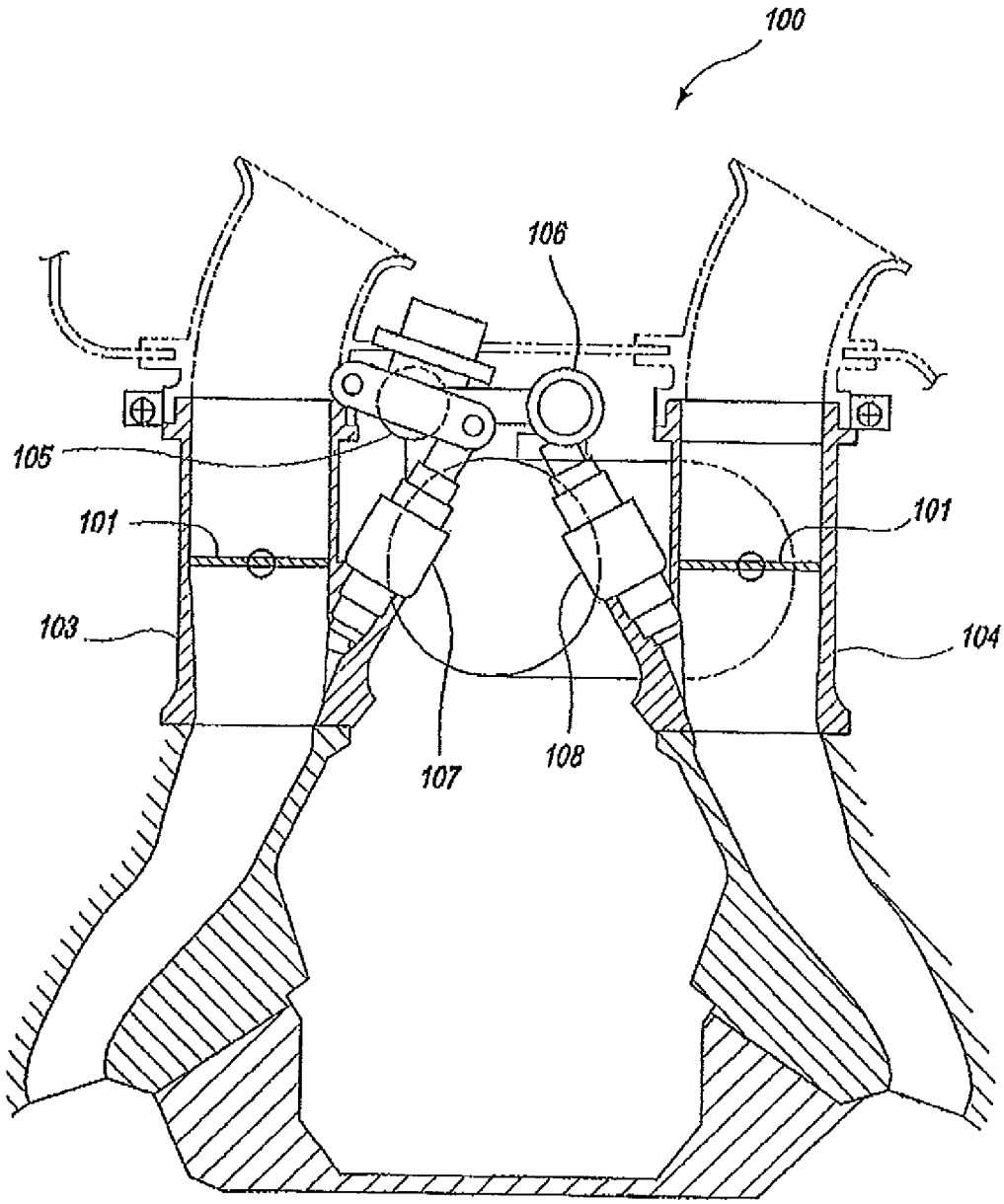
Fig. 12 PRIOR ART
FIG. 12 is a cross sectional view of the throttle body assembly of FIG. 11.

Connectors 77, 78 are connected to ECU (Electronic Control Unit) 80 shown in FIG. 10. Control signals are output to injectors 75 and 76 from ECU 80 through connectors 77, 78 whereby fuel injection from injectors 75 and 76 is controlled. FIG. 6 is a right side view showing throttle body assembly 50, but depiction of a right fixing plate 88*a* shown in FIG. 4 is omitted for the convenience of showing the configuration of connectors 77, 78.

As shown in FIG. 8, in a plan view, injector bodies 68, 69 are extended in a longitudinal direction and connectors 77, 78 are extended obliquely in the longitudinal direction. Specifically, first front connector 77*a* and second front connector 77*b* are extended obliquely rearward in mutually opposite senses in the vehicle width direction. More specifically, front connectors 77*a* and 77*b* are extended obliquely rearward and outward in the vehicle width direction. First rear connector 78*a* and second rear connector 78*b* are extended obliquely rearward in mutually opposite senses in the vehicle width direction. More specifically, rear connectors 78*a* and 78*b* are extended obliquely rearward and outward in the vehicle width direction.

An angle formed, as viewed in plan view, between a central axis of injector body 68*a* positioned outward in the vehicle width direction and a direction, in which first front connector 77*a* is extended, and an angle formed, as viewed in plan view, between a central axis of injector body 69*b* and a direction, in which second rear connector 78*b* is extended, are equally set to $\theta_1$. On the other hand, an angle formed, as viewed in plan view, between a central axis of injector body 68*b* positioned inward in the vehicle width direction and a direction, in which second front connector 77*b* is extended, and an angle formed, as viewed in plan view, between a central axis of injector body 69*a* and a direction, in which first rear connector 78*a* is extended, are equally set to $\theta_2$. $\theta_1$ and $\theta_2$ are set in a range in which front connectors 77 and rear connectors 78 do not positionally interfere with each other, and preferably in a range from 50 to 180°.

—Motor 60—

Figure 9:
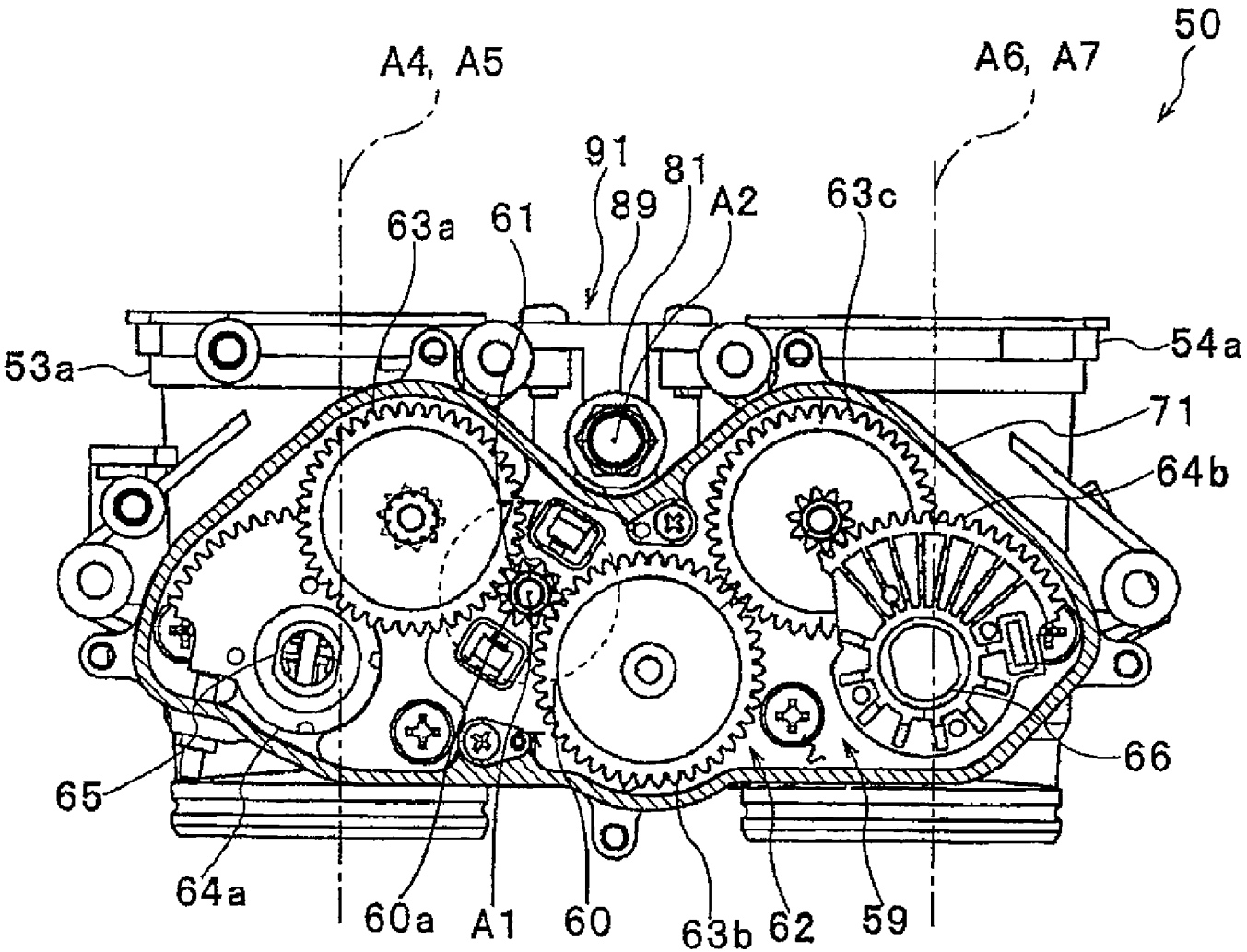
FIG. 9 is a partial cross sectional view of the throttle body assembly that shows the construction of a reduction gear mechanism.

Throttle body assembly 50 includes motor 60. As shown in FIG. 9, motor 60 includes a rotating shaft 60*a* as a first rotating shaft. An axis A1 of rotating shaft 60*a* extends in the vehicle width direction.

A motor pinion gear 61 is mounted to rotating shaft 60*a* and meshes with a transmission gear mechanism 62. Transmission gear mechanism 62 comprises three idle gears 63*a*, 63*b*, 63*c* and two counter gears 64*a*, 64*b*. Counter gear 64*a* is fixed to valve stem 65 and counter gear 64*b* is fixed to valve stem 66. Motor pinion gear 61 meshes with counter gear 64*a* through single idle gear 63*a*. On the other hand, since motor pinion gear 61 and counter gear 64*b* are relatively distant from each other, motor pinion gear 61 meshes with counter gear 64*b* through the two idle gears 63*b*, 63*c*. Thereby, when motor 60 is driven and motor pinion gear 61 is rotated, counter gears 64*a*, 64*b* are rotated and valve stems 65, 66 are rotated in the same direction. Consequently, front throttle valves 57*a*, 57*b* and rear throttle valves 58*a*, 58*b* shown in FIG. 4 are turned, so that opening and closing of front air cylinders 55 and opening and closing of air cylinders 56 occurs synchronously.

According to the embodiment, motor 60 and transmission gear mechanism 62 are generally referred to as a throttle valve driving mechanism 59.

As shown in FIG. 8, as viewed in plan view, motor 60 as an actuator is arranged in a region surrounded by central axis A4 of first front air cylinder 55*a*, central axis A5 of second front air cylinder 55*b*, central axis A6 of first rear air cylinder 56*a*, and central axis A7 of second rear air cylinder 56*b*. As shown in FIG. 9, motor 60 is arranged in a position lower than the upper ends of front throttle bodies 53 and rear throttle bodies 54 but higher than the lower ends thereof in the vertical direction. That is, motor 60 is positioned in a space surrounded by four throttle bodies: front throttle bodies 53*a*, 53*b* and rear throttle bodies 54*a*, 54*b*.

As shown in FIGS. 9 and 4, motor 60 is offset from fuel supply pipe 81 in the longitudinal direction. Specifically, axis A1 of rotating shaft 60*a* as a first rotating shaft of motor 60 and central axis A2 of fuel supply pipe 81 are positioned in different locations in the longitudinal direction. More specifically, axis A1 is positioned forwardly of central axis A2 of fuel supply pipe 81. That is, as shown in FIG. 9, motor 60 is arranged so that axis A1 is positioned between central axis A2 of fuel supply pipe 81 and central axes A4, A5 of front air cylinders 55 in the longitudinal direction.

—Casing 70—

As shown in FIGS. 4 and 8, motor 60 and transmission gear mechanism 62 are received in a casing 70. As shown in FIG. 8, valve stems 65, 66 connected to transmission gear mechanism 62 are inserted into casing 70.

Casing 70 comprises a first casing portion 71 and a second casing portion 72 that butt against each other in the vehicle width direction. Casing portions 71 and 72 are fixed to each other by bolts, rivets, or the like. First casing portion 71 is positioned on a side toward transmission gear mechanism 62 and is formed from a metal such as an alloy of iron, aluminum, stainless steel, etc. In one embodiment, first casing portion 71 is formed by aluminum die casting.

First casing portion 71 is fixed to first front throttle body 53*a* and first rear throttle body 54*a*. Specifically, that portion of casing 70 in which transmission gear mechanism 62 is received and into which valve stems 65, 66 are inserted, is fixed directly to first front throttle body 53*a* and first rear throttle body 54*a*.

Second casing portion 72 is positioned on a side toward motor 60 and is formed from a resin such as, for example, polybutylene terephthalate (PBT), etc. The resin that forms second casing portion 72, may also contain, for example, glass fiber, etc. In addition, like first casing portion 71, second casing portion 72 may be formed from a metal.

As shown in FIG. 8, second casing portion 72 is fixed to second rear throttle body 54*b* through a metallic stay 67. Stay 67 is bolted to a top of that portion of second casing portion 72, in which motor 60 is received, and is also bolted to second rear throttle body 54*b*, whereby second casing portion 72 is fixed to second rear throttle body 54*b*.

—Connecting Member 85—

As shown in FIG. 4, front throttle bodies 53*a*, 53*b* and rear throttle bodies 54*a*, 54*b* are fixed to each other by a connecting member 85. Connecting member 85 includes two inner connection pipes 86*a*, 86*b*, two outer connection pipes 87*a*, 87*b*, a right fixing plate 88*a*, and a left fixing plate 88*b*.

Inner connection pipes 86*a*, 86*b* and outer connection pipes 87*a*, 87*b* are extended in the vehicle width direction. As shown in FIG. 6, inner connection pipes 86*a*, 86*b* and outer connection pipes 87*a*, 87*b* are arranged in positions different in level from each other. Specifically, inner connection pipes 86*a*, 86*b* are arranged in substantially the same positions as upper ends of throttle bodies 53, 54 in a height direction. On the other hand, outer connection pipes 87*a*, 87*b* are arranged in substantially the same positions as central portions of throttle bodies 53, 54 in the height direction.

As shown in FIGS. 4 and 6, inner connection pipes 86*a*, 86*b* are arranged between central axes A4, A5 of front air cylinders 55 and central axes A6, A7 of rear air cylinders 56. Inner connection pipe 86*a* is fixed to front throttle bodies 53*a* and 53*b* rearwardly of central axes A4, A5 of front air cylinders 55, and inner connection pipe 86*b* is fixed to rear throttle bodies 54*a* and 54*b* forwardly of central axes A6, A7 of rear air cylinders 56. Inner connection pipe 86*a* and inner connection pipe 86*b* are fixed to each other in two locations by two fixing members 89 in a width direction. Connection pipes 86*a*, 86*b* and the two fixing members 89 may be generally referred to as inner connecting member 91 in the following description.

Outer connection pipe 87*a* is fixed to front throttle bodies 53*a* and 53*b* forwardly of central axes A4, A5 of front air cylinders 55. On the other hand, outer connection pipe 87*b* is fixed to rear throttle bodies 54*a* and 54*b* rearwardly of central axes A6, A7 of rear air cylinders 56.

In this manner, front throttle bodies 53*a* and 53*b* are firmly fixed and interposed by inner connection pipe 86*a* and outer connection pipe 87*a*. Also, rear throttle bodies 54*a* and 54*b* are firmly fixed and interposed by inner connection pipe 86*b* and outer connection pipe 87*b*.

Figure 5:
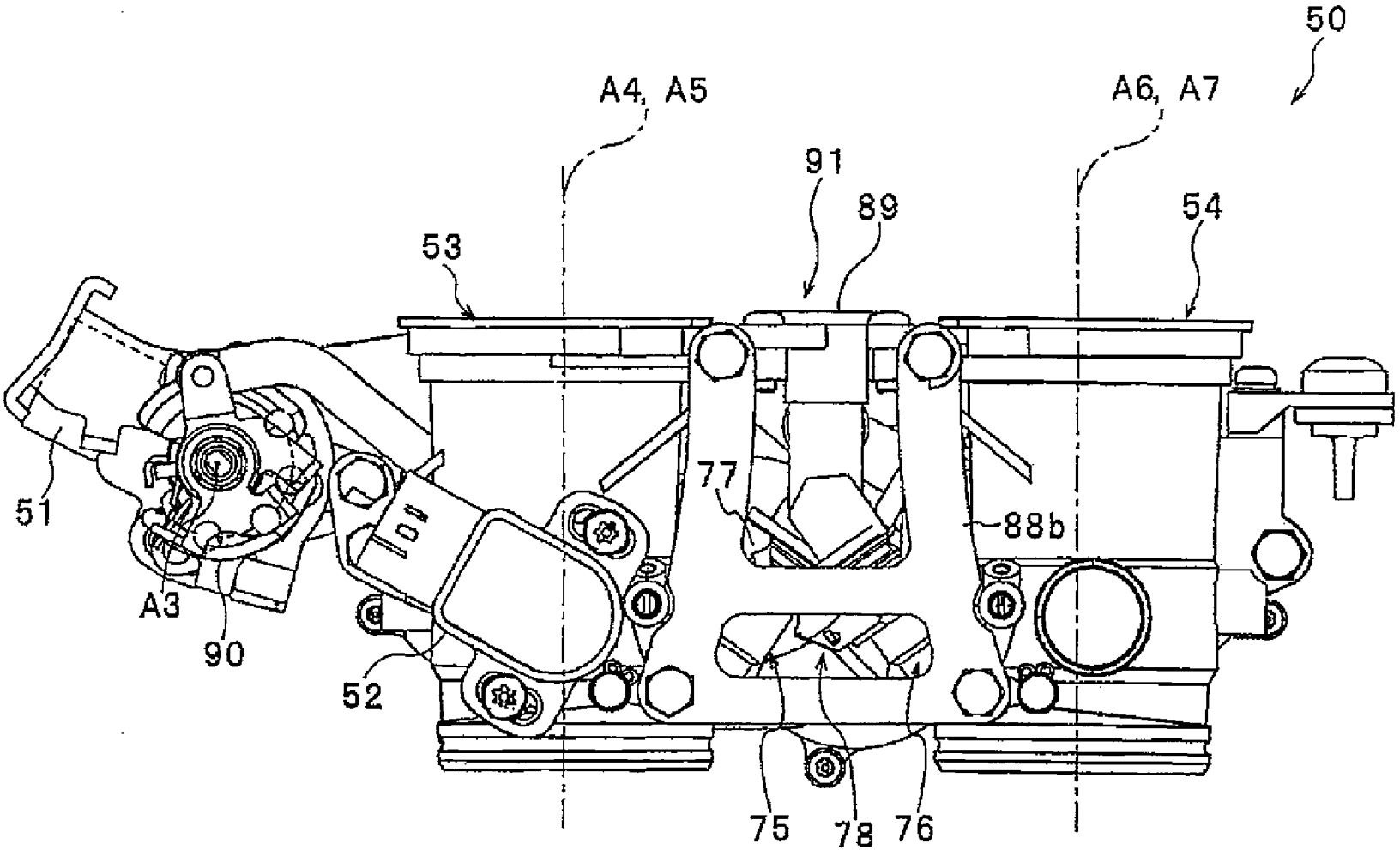
FIG. 5 is a left side view of the throttle body assembly.

Further, as shown in FIGS. 4 and 5, front throttle bodies 53*a*, 53*b* and rear throttle bodies 54*a*, 54*b* are fixed to each other by right fixing plate 88*a* as a right fixing member and left fixing plate 88*b* as a left fixing member. As shown in FIG. 5, left fixing plate 88*b* is fixed in four locations: upper and lower portions of second front throttle body 53*b* and upper and lower portions of second rear throttle body 54*b*. Right fixing plate 88*a* is fixed in four locations: upper and lower portions of first front throttle body 53*a* and upper and lower portions of first rear throttle body 54*a*.

In this manner, front throttle bodies 53*a*, 53*b* and rear throttle bodies 54*a*, 54*b* are fixed by right fixing plate 88*a*, left fixing plate 88*b* and inner connecting member 91. As viewed in plan view, only inner connecting member 91 as a connecting member that fixes front throttle bodies 53*a*, 53*b* and rear throttle bodies 54*a*, 54*b*, to each other is arranged in a region surrounded by central axes A4, A5 and central axes A6, A7. In the region surrounded by central axes A4, A5 and central axes A6, A7, any connecting member that fixes front throttle bodies 53*a*, 53*b* and rear throttle bodies 54*a*, 54*b* to each other is not arranged below fuel supply pipe 81.

—Accelerator Position Sensor 51 and Throttle Position Sensor 52—

As shown in FIG. 4, throttle body assembly 50 is provided with accelerator position sensor 51 and a throttle position sensor 52. Throttle position sensor 52 is arranged on the left of second front throttle body 53*b* and is connected to valve stem 65. Throttle position sensor 52 detects rotation of valve stem 65 to thereby detect a throttle position.

Accelerator position sensor 51 is connected to a right end of an APS shaft 90 as a second rotating shaft. As shown in FIG. 5, an axis A3 of APS shaft 90 is positioned in a lower position than the upper ends of front throttle bodies 53 and rear throttle bodies 54. In addition, in a case where the upper ends of front throttle bodies 53 and the upper ends of rear throttle bodies 54 are different in level from each other, APS shaft 90 is preferably arranged so that axis A3 is positioned in a lower position than higher ones of the upper ends of front throttle bodies 53 and the upper ends of rear throttle bodies 54.

As shown in FIGS. 4 and 5, as viewed in plan view, motor 60 is arranged in a region surrounded by central axes A4, A5 of front air cylinders 55 and central axes A6, A7 of rear air cylinders 56 while APS shaft 90 is arranged outside the region. Specifically, a central axis A3 of APS shaft 90 is positioned forwardly of central axes A4, A5 of front air cylinders 55 in a longitudinal direction. More specifically, as shown mainly in FIG. 2, APS shaft 90 is arranged between front head cover 38 and air cleaner 49 as viewed in side view. In this manner, APS shaft 90 and motor 60 are offset from each other in the longitudinal direction.

As shown in FIG. 4, a pulley 92 is mounted to APS shaft 90. A throttle wire 18 shown in FIG. 1 is wound around pulley 92. Therefore, throttle grip 17 is manually operated, whereby APS shaft 90 rotates when throttle wire 18 moves. Accelerator position sensor 51 detects rotation of APS shaft 90 to thereby detect an accelerator position.

(Control Block of Motorcycle 1)

The control block of motorcycle 1 shown in FIG. 10 is now described in detail. Motorcycle 1 comprises an ECU (Electronic Control Unit) 80 as a control unit. Various sensors such as accelerator position sensor 51, throttle position sensor 52, a speed sensor 94, etc. are connected to ECU 80. Accelerator position sensor 51 outputs an accelerator position to ECU 80. Throttle position sensor 52 outputs a throttle position to ECU 80. Speed sensor 94 outputs a car speed to ECU 80. ECU 80 is connected to and controls engine 31 on the basis of inputs such as accelerator position, throttle position, car speed, etc.

Throttle body assembly 50 is also connected to ECU 80. Specifically, motor 60 and injectors 75, 76 are connected to ECU 80. ECU 80 drives motor 60 on the basis of accelerator position, throttle position, car speed, etc. as input. Motor 60 is driven whereby valve stem 65 and valve stem 66 are rotated. Throttle valves 57, 58 are thereby moved to open and close air cylinders 55 and 56. Consequently, air sucked from air cleaner 49 is led into air cylinders 55, 56.

Simultaneously therewith, ECU 80 controls the quantity of fuel supplied from injectors 75, 76 on the basis of accelerator position, throttle position, car speed, etc. as input. Fuel jetted from injectors 75, 76 and air supplied from air cleaner 49 are mixed to create an air-fuel mixture that is supplied to intake ports 42*a*, 42*b* (FIG. 3).

According to the embodiment, motor 60 and fuel supply pipe 81 are offset from each other in the longitudinal direction. Specifically, axis A1 of rotating shaft 60*a*, which is largest in height dimension in motor 60, and central axis A2 of fuel supply pipe 81 are positionally shifted in the longitudinal direction. Therefore, motor 60 and fuel supply pipe 81 can be arranged close to each other in a height direction, and the height dimension of throttle body assembly 50 can be decreased. That is, by arranging motor 60 between throttle bodies 53 and 54 in the longitudinal direction and offsetting motor 60 and fuel supply pipe 81 in the longitudinal direction, both the longitudinal and height dimensions of throttle body assembly 50 can be decreased. Accordingly, both the longitudinal and height dimensions of engine unit 30 can be decreased.

Straddle-type vehicles such as motorcycles are strictly restricted in width and height. Therefore, the space in which throttle body assembly 50 and engine unit 30 are arranged is strictly restricted, and is further strictly restricted on a motorcycle having throttle body assembly 50 arranged between left and right frame portions 11*a*, 11*b*. Accordingly, the present invention, which decreases the size of engine unit 30, is especially useful in straddle-type vehicles such as motorcycles.

In throttle body assembly 100 described in JP-A-2002-256900, it is difficult to decrease the size of the throttle body assembly even if a single fuel supply pipe is used. Usually, the front and rear injectors are the same in length. Therefore, in case of connecting front and rear injectors to a common fuel supply pipe, the fuel supply pipe must be arranged intermediate the front and rear throttle bodies. Accordingly, a central portion of a motor being largest in a height direction and the fuel supply pipe are aligned in a vertical direction. Accordingly, in order to prevent positional interference between the motor, which is arranged intermediate the front and rear throttle bodies, and the fuel supply pipe, the fuel supply pipe and the motor must be arranged away from each other. Therefore, the height dimension of the throttle body assembly is increased and it is difficult to decrease the size thereof.

Also, fuel supply pipe 81 is common to injectors 75 and 76. Therefore, injectors 75 and 76 can be arranged close to each other as compared with a case where exclusive fuel supply pipes are provided for injectors 75 and 76. Accordingly, throttle body assembly 50 can be decreased in length in the longitudinal direction and the V bank angle $\theta_0$ of engine 31 can be decreased.

While the embodiment has been described with respect to a case where axis A1 of rotating shaft 60*a* is arranged forwardly of central axis A2 of fuel supply pipe 81, the same effect is obtained if axis A1 is arranged rearwardly of central axis A2.

As shown in FIGS. 4 and 8, motor 60 and fuel nipple 82 are offset from fuel supply pipe 81 on separate sides from each other. Therefore, positional interference between motor 60 and fuel nipple 82 is prevented and throttle body assembly 50 and engine unit 30 can be further decreased in size.

Specifically, according to the embodiment, fuel nipple 82 is extended rearward. Therefore, as shown in FIG. 1, fuel tank 19 arranged rearwardly of throttle body assembly 50 and fuel nipple 82 are readily connected to each other, and a fuel supply hose for connection of fuel tank 19 and fuel nipple 82 can be shortened.

Also, motor 60 and pulsation damper 83 are made offset from fuel supply pipe 81 on separate sides from each other. Therefore, positional interference between motor 60 and pulsation damper 83 is prevented and the size of throttle body assembly 50 and engine unit 30 can be further decreased.

The invention claimed is:

1. An engine unit comprising:

a V-type engine having a front cylinder connected to a front intake port and a rear cylinder connected to a rear intake port; and a throttle body assembly mounted to the V-type engine, wherein the throttle body assembly comprises:

a front throttle body formed with a front air cylinder connected to the front intake port and a front throttle valve for opening and closing the front air cylinder;

a rear throttle body formed with a rear air cylinder connected to the rear intake port and a rear throttle valve for opening and closing the rear air cylinder;

a fuel supply pipe arranged between a central axis of the front air cylinder and a central axis of the rear air cylinder in a longitudinal direction to extend widthwise in a lower position than a higher one of an upper end of the front throttle body and an upper end of the rear throttle body to supply fuel to the front air cylinder and the rear air cylinder; and a motor including a rotating shaft that extends in a width direction and is arranged between the central axis of the front air cylinder and the central axis of the rear air cylinder in a longitudinal direction to drive the front throttle valve and the rear throttle valve, wherein an axis of the rotating shaft of the motor is positioned forwardly or rearwardly of a central axis of the fuel supply pipe.

2. The engine unit according to claim 1, wherein the throttle body assembly further comprises a fuel nipple connected to the fuel supply pipe to supply a fuel to the fuel supply pipe, and the fuel nipple is extended toward an opposite side of the fuel supply pipe to the motor as viewed in plan view.

3. The engine unit according to claim 1, wherein the throttle body assembly further comprises a pulsation damper connected to the fuel supply pipe, and the pulsation damper is arranged on an opposite side of the fuel supply pipe to the motor as viewed in plan view.

4. A vehicle comprising the engine unit according to claim 1.

5. The vehicle according to claim 4, wherein:

a fuel tank is arranged rearwardly of the throttle body assembly, the throttle body assembly further comprises a fuel nipple connected to the fuel tank and the fuel supply pipe to supply fuel from the fuel tank to the fuel supply pipe, and in a longitudinal direction, the axis of the rotating shaft of the motor is positioned forwardly of the central axis of the fuel supply pipe while the fuel nipple is extended rearward from the fuel supply pipe.

6. The vehicle according to claim 4, comprising a motorcycle.

7. The vehicle according to claim 6, further comprising:

a head pipe; and left and right frames extending rearward from the head pipe, wherein the throttle body assembly is arranged between the left and right frames as viewed in plan view.

8. The engine unit according to claim 1, wherein the fuel supply pipe is positioned centrally between the central axis of the front air cylinder and the central axis of the rear air cylinder in the longitudinal direction.

9. The engine unit according to claim 1, wherein the axis of the rotating shaft of the motor is positioned between the central axis of the fuel supply pipe and the central axis of the front air cylinder in the longitudinal direction.

* * * * *

UNITED STATES PATENT AND TRADEMARK OFFICE

CERTIFICATE OF CORRECTION

PATENT NO. : 8,042,521 B2
APPLICATION NO. : 12/247883
DATED : October 25, 2011
INVENTOR(S) : Takayuki Yamada It is certified that error appears in the above-identified patent and that said Letters Patent is hereby corrected as shown below:

On Title Page, Item 74 (Attorney, Agent, or Firm)

"Robin & Berdo, PC" should be changed to --Rabin & Berdo, P.C.--

Signed and Sealed this
Eighteenth Day of December, 2012

David J. Kappos

David J. Kappos
*Director of the United States Patent and Trademark Office*